US005947714A

United States Patent [19]

Dreher

[11] Patent Number: 5,947,714

[45] Date of Patent: Sep. 7, 1999

[54] BURNER SURFACE

[75] Inventor: Horst Dreher, Buttwil, Switzerland

[73] Assignee: Yanis Holding S.A., Fribourg, Switzerland

[21] Appl. No.: 09/121,494

[22] Filed: Jul. 23, 1998

Related U.S. Application Data

[63] Continuation of application No. PCT/CH97/00004, Jan. 7, 1997.

[30] Foreign Application Priority Data

Jan. 26, 1996 [CH] Switzerland ..... 0203/96

[51] Int. Cl.[6] ..... F23C 5/00

[52] U.S. Cl. ..... 431/8; 431/298; 431/328; 431/349

[58] Field of Search ..... 431/8, 298, 326, 431/328, 329, 349; 239/559, 553

[56] References Cited

U.S. PATENT DOCUMENTS 3,061,001 10/1962 Reed .

*Primary Examiner*—Larry Jones
*Attorney, Agent, or Firm*—Notaro & Michalds P.C.

[57] ABSTRACT

A burner for gaseous fuels or gas plus liquid fuel mixtures includes flame bores distributed across a burner surface. At least some of the bores are arranged in the form of nearly equilateral triangles with a ratio of spacing of the bores with respect to one another, to the bore diameter, being in the range of 2 to 4.

12 Claims, 3 Drawing Sheets

BURNER SURFACE

CROSS-REFERENCE TO RELATED APPLICATIONS

This application is a continuation of International Application PCT/CH97/00004, filed Jan. 7, 1997.

The present invention relates to a burner for gaseous fuels or gas/liquid fuel mixtures with flame bores disposed in the burner surface, a process for reducing nitrogen oxides formed during the combustion of gaseous or gas-liquid fuels as well as uses of the burners according to the invention.

For new developments of furnace installations, in particular of furnace installations of gaseous fuels or gas-liquid fuel mixtures criteria such as economy, optimum efficiency and, in particular, decrease of emission of harmful substances, such as nitrogen oxides, carbon monoxide and noncombusted hydrocarbons, are requirements which must absolutely be met.

Reference is made in particular to the article "Entwicklung eines schadstoffarmen Vormischbrenners für den Einsatz in Haushaltsgasheizkesseln mit zylindrischen Brennkammern {development of a premix burner free of harmful substances for use in household gas heating boiler with cylindrical burning chambers}", Gaswärme International, Vol. 38 (1989), No. 1, pp. 28–34 by H. Berg and Th. Janemann.

Furthermore, a multiplicity of technical solutions for decreasing the generation of nitrogen oxides has been suggested by mixing into the gaseous fuel or fuel mixture before or during the combustion recirculated waste gases or flue gases in order to decrease the oxygen fraction. Thereby a temperature reduction in the flame generated in the combustion is attained which leads to a reduction of the formation of nitrogen oxides or can be nearly prevented. Since in particular in burners, such as are described for example in EP-A-218 602, with various regulatable burner [thermal] ratings the added quantity of waste gas or flue gas must also be varied, respectively controlled, this has a relatively expensive control as a prerequisite. This is necessary since otherwise the flame temperature is too low or too high depending on the burner [thermal] rating with which the burner is being operated.

In U.S. Pat. No. 3,936,003 a burner surface is suggested in which the discrete flame bores are spaced apart from each other such that between the flames waste gases or flue gases are drawn in by the flame root. It is herein however suggested to recycle hot waste gases whereby the flame does not cool down in the flame root but rather is heated even further. Therewith possibly a flame stability may be attained, however, simultaneously the fraction of nitrogen oxide in the waste gases is further increased which is undesirable.

In WO95/23315 it is also suggested to configure the flame bores with respect to one another such that between the flames waste gases or smoke gases are drawn back to the flame roots. However, in this publication special conditions are assumed, in that the processes suggested therein are suitable in particular for highly reactive combustion gases, such as for example for hydrogen/methane mixtures comprising more than 90% hydrogen. But such fuel mixtures are, as a rule, not present in the combustion of conventional fuels in furnace installations.

SUMMARY OF THE INVENTION

It is therefore one objective of the present invention to suggest a burner in which in extremely simple manner the dosing or addition of waste gases or fuel gases can take place, potentially also with varied burner [thermal] ratings.

The formulated objective is solved according to the invention by means of a new burner.

It is known that through the suitable selection of the burner surface the flame formation can be fundamentally determined in all details. This applies in particular to the phenomena of flame stability, carbon monoxide and nitrogen oxide emissions. For example, when a fluid jet, such as for example a gas/air mixture, exits an opening such as a tube or a hole, a free jet is formed. This draws in ambient medium and becomes mixed with it, as will be shown in the following with reference to FIG. 1. In the case of parallel free jets, these affect each other and a changed signature of the drawing in occurs depending on the characteristic parameters of the jet bundle.

If, as in the case of fuels, these fluid jets are ignited, discrete parallel flames are formed. Since these flames are also based on discrete fluid jets, ambient medium is now drawn into the flames. The originally pure fuel/air mixture becomes mixed with the ambient medium beginning with the region of the flame root at the burner surface. Since in the surrounding of the flames exclusively waste gas is present, the largely oxygen-free medium is mixed in (oxygen concentration in waste gas is only approximately 1 to 6%).

The fundamental concept of the present invention thus comprises mixing waste gas into the fuel/air mixture from the surrounding which allows for a drastic reduction of the formation of nitrogen oxides. Thereby the necessity becomes superfluous of drawing off waste gas from a combustion chamber and to add it to the fuel gas or gas mixture by means of pipe lines, control mechanisms and the like before it is combusted above the burner surface.

In particular in surface burners a relatively large number of discrete flames, similar to the above cited and at least nearly parallel, are generated. It is known that the burner surface comprises discrete holes, and, surprisingly, it was found according to the invention that by selecting a suitable geometry with respect to the discrete perforations as well as also with respect of one to the other, the precise adjustment of a flame structure becomes possible by means of which the emissions of carbon monoxide and nitrogen oxides can be minimized. No further supplementary aggregation of any kind such as smoke gas lines etc. are necessary, only through the suitable implementation of the burner surface alone does it become possible to convert the above cited fundamental idea according to the invention. It was found that preferably a triangular perforation pattern is selected wherein the flame bores are preferably disposed in the form of an at least nearly equilateral triangle. Preferred embodiment variants of the burner, or of the burner surface, according to the invention are disclosed in dependent claims 2 to 5.

According to a preferred embodiment variant of a burner pipe implemented according to the invention, it is implemented so as to be longitudinally displaceable in the axial direction. In this connection reference is again made to EP-A-218 602, in which a burner comprises a burner pipe which is supported such that it is displaceable in its longitudinal direction. It is known that the realization of a combustion system with low emissions requires optimization of the combustion process. For a stationary process the supply and removal of substances, energy and pulse is of fundamental importance. Effects of the kinetics of reaction, such as flame stability, harmful substance formation etc. must be taken into consideration. By optimization is understood bringing a system into a desired state through suitable variation of operating parameters and geometry. Since the operating parameters are largely given by the requirements obtaining, the geometry must be varied. This is attained in the case of a burner by implementing the burner surface in the above described form as well as through the axial longitudinal movement of the same as is known from EP-A-218 602. But it must be taken into consideration that the combustion chamber, or the heating boiler, is not being varied. At a high thermal rating modulation width such as for example 1:10, this leads to a burning chamber which is overdimensioned by one order of magnitude. From the technical aspect of heat exchanger this is certainly an advantage since the waste gas losses are minimized, however, in terms of combustion technology this leads to a flame formation which must be far from optimum since the flame is not subject to any kind of stabilizing effects through the burning chamber.

In particular through the implementation according to the invention of the burner surface and the mixing-in, consequently resulting therefrom, of waste gases this leads to problems in the area of flame stability leading to increased emissions of carbon monoxide and noncombusted hydrocarbons. It is therefore a further objective of the present invention, taking into consideration the fundamental idea and the suggested embodiment of the burner surface with the cited perforation pattern and at a high thermal rating modulation width, for example generated by the axial displacement of the burner into and out of the burning chamber, to suggest a solution which even at low burner thermal rating keeps the emissions of carbon monoxide and noncombusted hydrocarbons at a low level. Thus, an optimization objective exists to find a solution at low combustion [thermal] rating in which the burn chamber must also be included.

According to the invention this formulated objective is solved by means of a burner according to the invention. It is suggested that on the burner an additional surface region with the perforation pattern suggested according to the invention is implemented but wherein the geometric conditions are selected to be different. In particular on a burner pipe which is disposed such that it is longitudinally displaceable in the axial direction into and out of the burn chamber, it is suggested that in or on the cylinder bottom closing off the cylindrical burner pipe, axially and concentrically projecting from it, a further burner pipe with smaller diameter is disposed. Further preferred embodiment variants of the burner pipe according to the invention are characterized.

The burners suggested according to the invention are in particular suitable for surface burners.

BRIEF DESCRIPTION OF THE DRAWINGS

In the following the invention will be explained in further detail by example and with reference to the enclosed Figures.

Therein depict.

DESCRIPTION OF THE PREFERRED EMBODIMENTS

Figure 1:
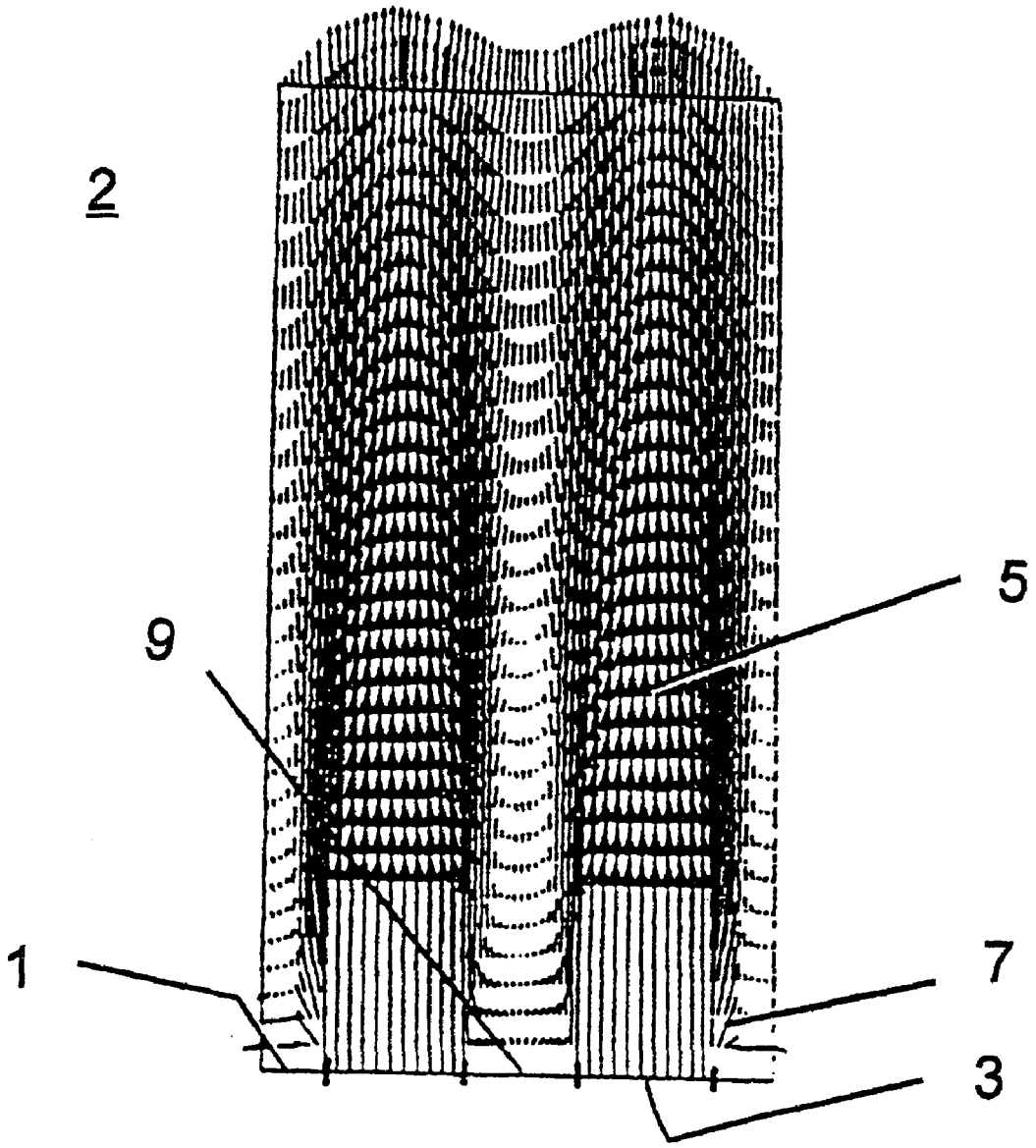
FIG. 1 schematically and in section parallel free jets such as are formed as a rule in the combustion of gaseous fuels, FIG. 2 a perforation pattern suggested according to the invention on a burner surface, and FIG. 3 in section an embodiment variant of a burner pipe according to the invention comprising an addition burner pipe for operating a so-called base-load stage.

FIG. 1 depicts schematically two parallel free jets 5 which can be, for example, two ignited fluid jets. These are generated by introducing a gaseous fuel through flame bores 3 at a burner surface 1 into a burn chamber 2 for combustion. In particular at the flame root 7 through the gas streaming into the burn chamber 2 are drawn into the fuel gas mixture ambient gases and mixed with it. In order for the mixing-in of the waste gases from the surrounding to take place according to the invention in optimum manner, a burner surface is preferred corresponding to a perforation pattern depicted in FIG. 2.

Figure 2:
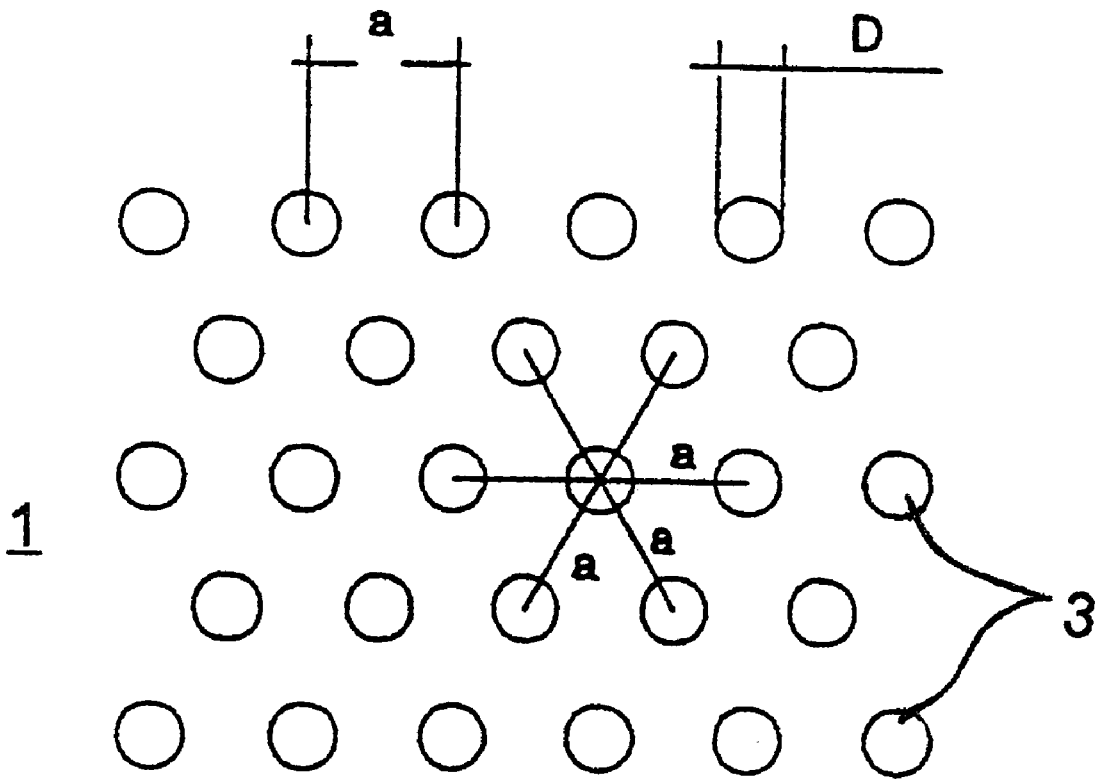

FIG. 2 shows a burner surface 1 comprising a multiplicity of flame bores or discrete perforations 3 which are disposed such that each perforation has an identical spacing, preferably corresponding to an equilateral triangle, or approximately identical spacing from each of its immediate neighbor perforations. The spacing of the perforation is denoted in FIG. 2 by "a" and the diameter of the perforations by "D".

Starting from the laws of similarities of the theory of fluid mechanics (Theorem II by Buckingham) precisely two dimensionless characteristics can be derived which are relevant for the quantity of ambient medium drawn in through the discrete jets. These are Reynold's number $II_1$ as well as the dimensionless ratio $II_2$ of the distance a to the diameter D.

$$II_1 = \frac{D * u}{\upsilon} \qquad \text{I}$$

$$II_2 = \frac{a}{D} \qquad \text{II}$$

Therein are u=velocity of the medium streaming out of the bore, for example gas/air, and ν=kinematic viscosity of the medium.

It has been known for a long time that by recirculation of waste gas the formation of thermal nitrogen oxide can be extremely strongly reduced. Reference may be made in this connection to the dissertation by H. Dreher "Abgasrezirkulation zur Stickoxidminderung—Bestimmung der Rezirkulationsrate in Brenner/Kessel-Kombinationen mittels numerischer Simulation" {Waste gas recirculation for nitrogen oxide reduction—Determination of recirculation rate in burner/boiler combination by means of numerical simulation}, ETH Zürich, 1994. As stated above, previous processes use for this purpose either pipe lines as well as a smoke gas ventilator in order to resupply the waste gas from the burn chamber or the chimney to the burner again or a Venturi nozzle so that with the air jet of the burner the waste gas is directly drawn in from the burn chamber.

The present invention uses for the waste gas circulation only the optimum implementation of the burner surface (perforation configuration) as stated already above. For the optimum implementation of the perforation pattern configuration of the burner surface of a surface burner with low radiation the following equilateral triangles or similar patterns with the following parameters have been found to be advantageous:

$$1.5 < a/D < 6 \ [-]$$

$$3 < D < 10 \ [\text{mm}]$$

Preferred parameter values represent therein the values a/D of 2 to 4, respectively of 2.2 to 3.5, while the value for the diameter D is a function of the [thermal] rating of the burner.

Figure 3:
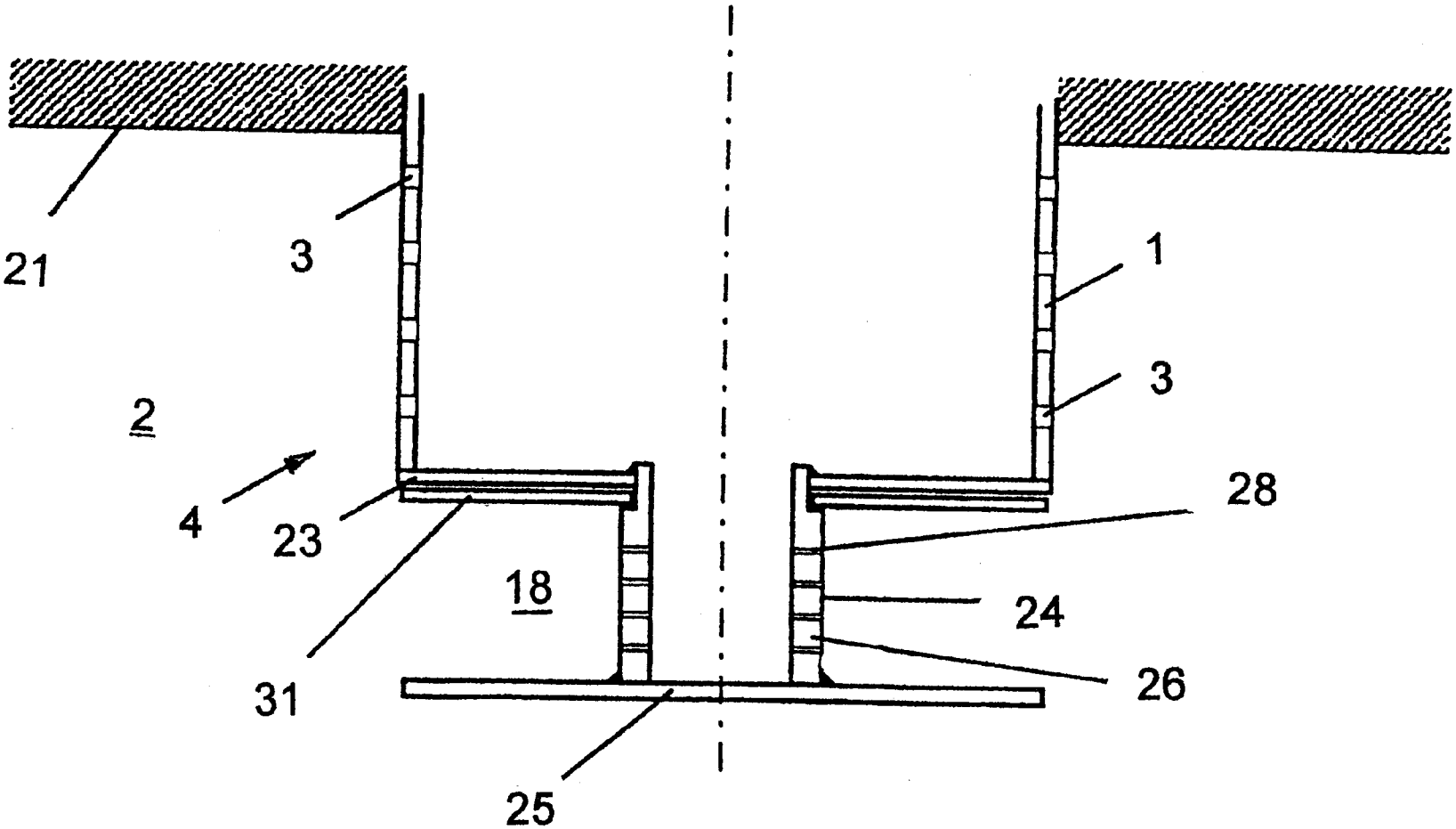

In FIG. 3 is shown in section a burner pipe 4 comprising, on the one hand, a burner surface 1 with the perforation patterns suggested according to the invention as well as with an additional arrangement for the implementation of a so-called base-load stage. The burner pipe 4 implemented according to the invention can be moved, displaceable longitudinally (arrow) in the axial direction on the burn chamber wall 21, into or out of the burn chamber 2. Depending on the position of the burner pipe 4 a multiplicity of the perforations 3 disposed according to the invention in the burn chamber 2 is exposed, or closed. By moving the burner pipe it is possible to vary the operating parameters, or the [thermal] rating, of the burner. But simultaneously the burn chamber, or the heating boiler, is not varied. The [thermal] rating modulation width generated in this way leads to a burn chamber which, in the extreme case, is overdimensioned by one order of magnitude. In particular in the case in which the burner pipe is largely pulled back out of the burn chamber 2, this leads to a flame formation which is far from optimum since the flame is not subject to any type of stabilizing effect through the burn chamber. For this reason, now according to the invention a so-called base-load stage is suggested which makes available for the flame the "burn chamber" necessary for its stabilization and thus permits optimization of the combustion. The burn chamber suggested according to the invention of the flames in the small [thermal] rating range is disposed at the front side on the burner pipe 4 and denoted by the reference symbol 18. This burn chamber 18 of the base-load stage is formed, on the one hand, by an additional further burner pipe 24 disposed at the front side on the burner pipe 4, on whose burner surface 26, again, flame bores or perforations 28 corresponding to the suggested perforation pattern according to the invention are disposed. These bores 28 comprise preferably a smaller diameter D than the diameter of bores 3 in the surface 1 of the burner pipe 4. At the front side on this further burner pipe 24 is suggested a lower axial limitation 25, which is produced advantageously of a material which glows. Of the same material is preferably also produced the upper annularly implemented limitation 31 which is disposed annularly axially about the further burner pipe 24 covering the front-side surface of the cylinder bottom of the burner pipe 4. This burn chamber 18 of the flames in the low [thermal] rating range is thus disposed on the burner pipe 4 and is moved jointly. Thus, no relative motion of burner and burn chamber in the lowest [thermal] rating range results. The magnitude of the base-load stage can extend from approximately 5 to 30% of the full load, preferably from 5 to 10%. The implementation of the burner surface of the further burner pipe or the so-called base-load stage, takes place by means of the same above described pattern which is also used for the main burner surface 1. The parameter selection of pattern a/D and D can take place differently for base-load and main burner surface. Thereby that the upper and lower limitation of the base-load stage comprises advantageously a glowable material, it is attained that at any time, even if the flame is locally or nonstationarily extinguished (typical phenomenon of turbulent flames), the gas streaming past is heated and ignited again. This permits approximately the operation free of carbon monoxide, even at base load.

The advantage of the implementation according to the invention of a burner according to FIG. 3 resides in the assurance of the optimization of the flame formation in all [thermal] rating modulation ranges and thereby obtaining extremely low emissions of carbon monoxide and nitrogen oxides. But, it becomes thereby also possible to provide a burner with a burner surface suggested according to the invention and to operate it at different [thermal] ratings without the size of the burn chamber being relevant for ensuring optimum emission values or that optimum emission values are also possible with overdimensioned burn chambers.

For non-circular perforations the comparison circle diameter formed by the perforation area must be anticipated according to the formula:

$$D_{eq}=\sqrt{4\ A_2/\Pi}$$

$D_{eq}$=equivalent (comparison) diameter $A_2$=cross sectional area of the discrete perforation

I claim:

1. Burner of the recirculation type for gaseous fuels or gas/liquid fuel mixtures with flame bores disposed in the burner surface, comprising: at least some of the flame bores being arranged in the form of at least nearly equilateral triangles, a ratio (a/D) of spacing (a) of the bores with respect to one another to the bore diameter (D) having a value in the range from 2 to 4, the bore diameter being in the range of approximately 3 to 10 mm.

2. Burner as claimed in claim 1, wherein the value for the ratio (a/D) is in a range from 2.2 to 3.5.

3. Burner as claimed in claim 1, including a non-planar burner wall, said flame bores being in the non-planar burner wall.

4. Burner for gaseous fuels or gas/liquid fuel mixtures with flame bores disposed in the burner surface, comprising: at least some of the flame bores being arranged in the form of at least nearly equilateral triangles, a ratio (a/D) of spacing (a) of the bores with respect to one another to the bore diameter (D) having a value in the range from 2 to 4, the bore diameter being in the range of approximately 3 to 10 mm, and a substantially cylindrically burner pipe with a wall, said flame bores being disposed in the burner pipe wall.

5. Burner as claimed in claim 4, wherein the burner pipe is disposed such that it can be displaced longitudinally along its axial direction.

6. Burner as claimed in claim 4, wherein the burner pipe forms a main burner surface with a cylinder bottom closing off the cylindrical burner pipe, and a further burner pipe with smaller diameter disposed as a base-load stage projecting beyond the bottom.

7. Burner as claimed in claim 6, wherein the ratio (a/D) of flame bores disposed in the further burner pipe, is in the same range of values as the first mentioned ratio (a/D).

8. Burner as claimed in claim 6, wherein the diameter (D) of the bores in the further burner pipe are smaller than the bores in the main burner surface.

9. Burner as claimed in claim 6, wherein the further burner pipe is cylindrically with a front-side closure bottom which is radially projecting beyond the cylinder wall, with a diameter approximately corresponding to the diameter of the burner pipe of the main burner, and a free surface of the cylinder bottom of the main burner, an annular wall is disposed covering this surface with the closure bottom and annular wall.

10. Process for reducing the nitrogen oxides during the combustion of a gaseous or gaseous/liquid fuel or fuel mixture on a recirculation burner nozzle or a burner pipe with flame bores, comprising: disposing ignited fluid jets at a spacing one from the other such that ambient medium, comprising waste gas or smoke gas, is drawn in a region of a root of a flame in order to reduce the temperature of the flame with a ratio of the spacing (a) of the bores to each other to the bore diameter (D) of the bores being in a range from 2 to 4 and, supplying to the flame root with the fuel gas/air mixture, substantially pure and substantially oxygen free medium.

11. Process as claimed in claim 10, wherein combustion takes place by means of a burner having a burner pipe.

12. Process as claimed in claim 11, wherein the burner pipe for controlling an active burner surface is moved in an axial direction into or our of a burn chamber, with the burner pipe at base load moved to maximally up to the cylinder closure bottom from the burn, and the combustion of the fuels, which consequently takes place in a lowest rating range, takes place only by means of a further burner pipe projecting at a front of the burner pipe.

* * * * *

UNITED STATES PATENT AND TRADEMARK OFFICE

CERTIFICATE OF CORRECTION

PATENT NO. : 5,947,714

DATED : September 7, 1999

INVENTOR(S) : Horst DREHER

It is certified that error appears in the above-identified patent and that said Letters Patent is hereby corrected as shown below:

Title page [73] Assignee: please change "Yanis Holding S.A." to --YGNIS HOLDING S.A.--

Signed and Sealed this

Ninth Day of May, 2000

*Attest:*

Q. TODD DICKINSON

*Attesting Officer*

*Director of Patents and Trademarks*